US005753606A

United States Patent [19]

Hees et al.

[11] Patent Number: 5,753,606

[45] Date of Patent: May 19, 1998

[54] LOW-FOAMING DETERGENTS OR CLEANING FORMULATIONS

[75] Inventors: Udo Hees, Mayen; Eva Kiewert, Duesseldorf; Ansgar Behler, Bottrop; Astrid Haferkamp, Monheim; Kerstin Link, Viersen; Amerigo Pastura, Witten; Nada Volf, Duesseldorf; Guenther Vogt, Toenisvorst, all of Germany

[73] Assignee: Henkel Kommanditgesellschaft auf Aktien, Dusseldorf, Germany

[21] Appl. No.: 596,086

[22] PCT Filed: Jul. 26, 1994

[86] PCT No.: PCT/EP94/02466

§ 371 Date: Mar. 4, 1996

§ 102(e) Date: Mar. 4, 1996

[87] PCT Pub. No.: WO95/04803

PCT Pub. Date: Feb. 16, 1995

[30] Foreign Application Priority Data

Aug. 4, 1993 [DE] Germany ..... 43 26 112.4

[51] Int. Cl.[6] ..... C11D 1/12

[52] U.S. Cl. ..... 510/422; 134/40; 510/434; 510/470; 510/535

[58] Field of Search ..... 510/470, 421, 510/422, 434, 535

[56] References Cited

U.S. PATENT DOCUMENTS

| | | | |
|---|---|---|---|
| 5,292,910 | 3/1994 | Raths et al. | 554/149 |
| 5,374,716 | 12/1994 | Biermann et al. | 536/18.6 |
| 5,464,874 | 11/1995 | Balzer | 510/470 X |
| 5,523,016 | 6/1996 | Giesen et al. | 510/427 |

FOREIGN PATENT DOCUMENTS

| | | |
|---|---|---|
| 0070076 | 1/1981 | European Pat. Off. . |
| 0030096 | 6/1981 | European Pat. Off. . |
| 0105556 | 4/1984 | European Pat. Off. . |
| 0070074 | 6/1988 | European Pat. Off. . |
| 0301298 | 2/1989 | European Pat. Off. . |
| 0408965 | 1/1991 | European Pat. Off. . |
| 4227046 | 2/1993 | Germany . |
| WO8809369 | 12/1988 | WIPO . |
| WO9003977 | 4/1990 | WIPO . |
| WO9013533 | 11/1990 | WIPO . |
| WO9114760 | 10/1991 | WIPO . |
| WO9115441 | 10/1991 | WIPO . |

OTHER PUBLICATIONS

"Seifen–Öle–Fette–Wachse", 112, 371, (1986).

*Primary Examiner*—Michael Lusignan
*Attorney, Agent, or Firm*—Wayne C. Jaeschke; John E. Drach; Henry E. Millson, Jr.

[57] ABSTRACT

A water-containing detergent or cleaning composition comprising

A) at least one alkyl polyglycosides corresponding to the formula $R^1$—O—$(Z)_x$ (I), where $R^1$ is a linear or branched, saturated or unsaturated alkyl group containing 8 to 18 carbon atoms, Z is a sugar unit, and x is an integer of 1 to 10; and B) at least one fatty acid alkyl ester alkoxylate of the formula $R^2CO_2$—$(AO)_y$—$R^3$ (II), where $R^2$ is a branched or linear, saturated or unsaturated alkyl group containing 5 to 21 carbon atoms, AO is a $C_{2-4}$ alkylene oxide unit, y is a number of 1 to 30 and $R^3$ is a linear or branched alkyl group containing 1 to 6 carbon atoms; and methods for using the above composition.

20 Claims, No Drawings

LOW-FOAMING DETERGENTS OR CLEANING FORMULATIONS

BACKGROUND OF THE INVENTION

1. Field of the Invention

This invention relates to low-foaming detergents or cleaning formulations, preferably liquid detergents and cleaning formulations for hard surfaces. Cleaning formulations for hard surfaces are understood to be any non-textile surfaces occurring in the domestic and institutional sector with the exception of crockery. The name "multipurpose cleaners" has been coined for cleaning formulations of this type. Low-foaming multipurpose cleaners are those which, when manually applied, develop a low volume of foam which undergoes a significant further reduction within a few minutes.

2. Statement of Related Art

Multipurpose cleaners have long been known. They are essentially aqueous surfactant solutions of various kinds with or without additions of builders and with or without additions of water-soluble solvents or solubilizers. In practice, the high foaming power of multi-purpose cleaners has been increasingly found to be a disadvantage where they are manually applied. Although the user wants to see some foaming by the cleaning solution as proof of its effectiveness at the beginning of the particular cleaning task, the foam should then disappear again as quickly possible so that surfaces once cleaned do not have to be rewiped.

In many cases, liquid detergents also tend to generate large volumes of foam which restricts their usefulness in washing machines.

In order to meet this increasing demand for lower foaming power, some manufacturers of multipurpose cleaners have started significantly reducing the surfactant content of their products which does of course lead in turn to a significant loss of cleaning power. The user of such products has to compensate for the loss of cleaning power by greater mechanical effort in wiping.

By virtue of their favorable ecological properties, alkyl polyglycosides (APG's) are enjoying increasing popularity in detergents and cleaning formulations. However, alkyl polyglycosides are known to be high-foaming surfactants. Accordingly, they are recommended for products which are required to develop high foaming power, i.e. for example for manual dishwashing detergents or for hair shampoos. EP 0 070 074 B1 and 0 070 076 B2 describe corresponding high-foaming detergents and cleaning formulations based on various APG-containing surfactant combinations. Accordingly, these combinations are also not recommended for multipurpose cleaners.

Special short-chain $C_{8-10}$ alkyl glucosides (for example Triton®CG-110, a product of Rohm & Haas) have also been known for some time as high-foaming nonionic surfactants which develop a stable foam. Low-foaming cleaning formulations containing alkyl polyglucosides for use in cleaning machines, especially dishwashing machines, are described in WO 88/09369. These formulations acquire their low-foaming character through the presence of conventional low-foaming fatty alcohol alkoxylates which have an HLB value of around 10 or lower and which may contain propylene oxide units.

Detergent mixtures based on fatty acid alkyl ester alkoxylates are described in DE-OS 42 27 046.

DESCRIPTION OF THE INVENTION

The problem addressed by the present invention was to provide detergents or cleaning formulations which would combine high cleaning power and ready biodegradability with very low foaming power. Where the formulations are used for the manual cleaning of hard surfaces, very low foaming power means that any foam initially formed should visibly diminish within 2 minutes.

It has now surprisingly been found that liquid detergents and multipurpose cleaners which combine high cleaning power with extremely low foaming behavior can be obtained by using combinations of certain $C_{8-16}$ alkyl polyglycosides which are known to be high-foaming with certain fatty acid alkyl ester alkoxylates.

The present invention relates to water-containing detergents or cleaning formulations containing 0.1 to 50% by weight and preferably 1 to 20% by weight of at least one alkyl polyglycoside corresponding to formula (I): $R^1$—O—$(Z)_x$ (I), where $R^1$ is a linear or branched, saturated or unsaturated alkyl group containing 8 to 18 carbon atoms, Z is a sugar unit, preferably a glucose or xylose unit, and x is an integer of 1 to 10, and 0.05 to 50% by weight and preferably 1 to 20% by weight of at least one fatty acid alkyl ester alkoxylate corresponding to formula (II): $R^2CO_2$—$(AO)_y$—$R^3$ (II), where $R^2$ is a branched or linear, saturated or unsaturated alkyl group containing 5 to 21 carbon atoms, AO is a $C_{2-4}$ alkylene oxide unit, y is a number of 1 to 30 and $R^3$ is a linear or branched alkyl group containing 1 to 6 carbon atoms.

The alkyl polyglycosides used in the detergents according to the invention are known substances which may be obtained by the relevant methods of preparative organic chemistry. EP 0 301 298 A1 and WO 90/3977 are cited as representative of the literature available on the subject. The alkyl polyglycosides may be derived from sugars or sugar residues, i. e. aldoses or ketoses containing 5 or 6 carbon atoms, preferably glucose and xylose. Accordingly, the preferred alkyl polyglycosides are alkyl polyglucosides and alkyl polyglycosides.

The index x in formula (I) indicates the degree of oligomerization (DP degree), i. e. the distribution of mono- and oligoglycosides, and is a number of 1 to 10. Whereas x in a given compound must always be an integer and, above all, may assume a value of 1 to 6, the value x for a certain alkyl polyglycoside is an analytically determined calculated quantity which is generally a broken number. Alkyl polyglycosides with an average degree of oligomerization of 1.1 to 3.0 and preferably 1.1 to 1.7 are preferably used.

The alkyl radical $R^1$ in formula (I) may be derived from primary branched and unbranched alcohols containing 8 to 18 carbon atoms. Typical examples are myristyl alcohol, cetyl alcohol and technical mixtures thereof. However, alkyl polyglycosides corresponding to formula (I), in which $R^1$ is a hydrocarbon radical containing 8 to 12 and, more particularly, 8 to 10 carbon atoms, are preferred. Besides lauryl alcohol, typical examples are in particular capryl alcohol and capric alcohol and the technical mixtures thereof obtained, for example, in the hydrogenation of technical fatty acid methyl esters or in the hydrogenation of aldehydes from Roelen's oxo synthesis.

The fatty acid alkyl ester alkoxylates of formula (II) used in the formulations according to the invention may be prepared by conventional methods, for example by esterification of fatty acid derivatives with alkoxylated methanol. However, this process is attended by certain disadvantages: it involves two stages, the esterification reaction lasts a very long time and the products are discolored by the high reaction temperatures. In addition, correspondingly produced fatty acid methyl ester alkoxylates often have relatively high OH values after esterification which can be problematical for certain applications. The fatty acid alkyl ester alkoxylates corresponding to formula (II) are preferably produced by the heterogeneously catalyzed direct alkoxylation of fatty acid alkyl esters with alkylene oxide, more particularly ethylene oxide. This synthesis process is described in detail in WO 90/13533 and WO 91/15441. The products formed are distinguished by a low OH value, the reaction is carried out in a single stage and light-colored products are obtained. Fatty acid alkyl ester alkoxylates corresponding to formula (II) which are obtained by ethoxylation of fatty acid methyl ester, i. e. in which AO in formula (II) is an ethylene oxide unit and $R^3$ is a methyl group, are preferably used. The fatty acid methyl esters used as starting materials may be obtained from natural oils and fats or may be synthetically produced.

Fatty acid alkyl ester alkoxylates in which y is a number of 5 to 25 and, more particularly, 9 to 18 are preferably used in the multipurpose cleaners according to the invention. By contrast, fatty acid alkyl ester alkoxylates, in which $R^2$ is a linear or branched, saturated alkyl group containing 12 to 18 carbon atoms and y is a number of 3 to 15, are used in the liquid detergents according to the invention.

If the liquid detergents and multipurpose cleaners according to the invention are to be used for the removal of lipophilic soils, fatty acid alkyl ester alkoxylates with a low degree of ethoxylation in the range according to the invention are used. If hydrophilic soils are to be removed, it is advisable to use fatty acid alkyl ester ethoxylates with relatively high degrees of ethoxylation in the range according to the invention.

In one preferred embodiment of the invention, the liquid detergents and multipurpose cleaners mentioned above additionally contain an anionic surfactant selected from the group of $C_{6-18}$ alkyl benzene sulfonates, $C_{6-18}$ alkane sulfonates, $C_{6-18}$ alkyl sulfates, $C_{6-18}$ alkyl polglycol ether sulfates, α-olefin sulfonates, $C_{6-18}$ alkyl polyglycol ether sulfonates, glycerol ether sulfonates, glycerol ether sulfates, hydroxy mixed ether sulfates, monoglyceride sulfates, sulfosuccinates, sulfotriglycerides, soaps, amide soaps, $C_{6-18}$ fatty acid amide ether sulfates, $C_{6-18}$ alkyl carboxylates, fatty acid isethionates, N-$C_{6-18}$-acyl sarcosinates, N-$C_{6-18}$-acyl taurides, $C_{6-18}$ alkyl oligoglucoside sulfates, $C_{6-18}$ alkyl phosphates and mixtures thereof in a total quantity of up to 40% by weight, based on the total weight of the liquid detergent or multipurpose cleaner.

In another preferred embodiment, the liquid detergents or multipurpose cleaners according to the invention additionally contain another nonionic surfactant selected from the group of $C_{6-18}$ alkyl polyglycol ethers, sugar esters, $C_{6-18}$ fatty acid polyglycol ethers, sorbitan fatty acid esters, $C_{6-18}$ fatty acid partial glycerides and mixtures thereof in a total quantity of up to 30% by weight, based on the total quantity of liquid detergent or multipurpose cleaner.

Particularly preferred embodiments contain anionic surfactants selected from the group of $C_{6-18}$ alkyl sulfates, $C_{6-18}$ alkyl polyglycol ether sulfates, soaps and $C_{6-18}$ alkane sulfonates and mixtures thereof or nonionic surfactants selected from the group of $C_{6-18}$ alkyl polyglycol ethers.

The soaps to be used in accordance with the invention are alkali metal, ammonium or alkanolammonium salts of saturated or unsaturated fatty acids containing 8 to 22 and preferably 10 to 18 carbon atoms. The soaps may either be added as such or may be formed after addition of corresponding fatty acids by salt formation with bases such as, for example, NaOH, KOH, $NH_3$, amines or alkanolamines. Depending on the pH value established in the formulations according to the invention, the soaps are either completely neutralized or are partly present in free form as a fatty acid.

The $C_{6-18}$ alkyl ether sulfates are primarily addition products of 2 to 15 moles of ethylene oxide with $C_{6-18}$ fatty alcohols which are subsequently sulfated. The $C_{6-18}$ alkyl polyglycol ethers used as nonionic surfactants are primarily addition products of 2 to 10 moles of ethylene oxide with $C_{6-18}$ fatty alcohols.

Typical auxiliaries may optionally be added to liquid detergents or multipurpose cleaners. Typical auxiliaries in the context of the invention are builders, for example glutaric acid, succinic acid, adipic acid, tartaric acid, benzene hexacarboxylic acid, gluconic acid, trisodium citrate; solvents, for example acetone, ethanol or glycerol; hydrotropes, for example cumene sulfonate, octyl sulfate, butyl glucoside, butylene glycol; cleaning boosters; viscosity regulators, for example synthetic polymers, such as polyacrylates; pH regulators, for example citric acid, triethanolamine or NaOH; preservatives, for example glutaraldehyde; dyes and fragrances and also opacifiers.

The pH value of the multipurpose cleaners according to the invention is typically between 4 and 8.5 and preferably between 6 and 8. In a particularly preferred embodiment, however, their pH value is in the range from 7.0 to 7.5. The pH value for an in-use concentration of 10 g/l is preferably in the range from 7.3 to 7.8.

The formulations according to the invention are particularly suitable for the cleaning of hard surfaces, for example enamel, glass, PVC, linoleum, stone floors, for example of marble, terrazzo, non-glazed clinker, ceramic tiles or sealed wood floors, for example parquet or boards.

The pH value of the liquid detergents according to the invention is typically between 6.0 and 10.0 and preferably between 7.0 and 9.0.

The liquid detergents are suitable both for use in washing machines and for use in hand washing basins for washing high-quality textiles of wool or silk.

EXAMPLES

To demonstrate the advantages of the multipurpose cleaners according to the invention over known multipurpose cleaners for hard surfaces, comparison tests were carried out to determine foaming power and foam collapse.

Cleaning power:

Cleaning power was tested by the method described in "Seifen-Öle-Fette-Wachse", 112, 371, (1986) which provides highly reproducible results. In this test, the cleaner to be tested is applied to an artificially soiled plastic surface in the form of a 1% by weight aqueous solution (10 g/l). A mixture of soot, machine oil, triglyceride of saturated fatty acids and low-boiling aliphatic hydrocarbon was used as the artificial soil where the cleaner was applied in dilute form. The 26×28 cm test surface was uniformly coated with 2 g of the artificial soil using a surface coater.

A plastic sponge was soaked with 10 ml of the 1% cleaning solution to be tested and mechanically moved over the soiled test surface to which 10 ml of the 1% cleaning solution to be tested had also been applied. After 10 wiping movements, the cleaned test surface was held under running water and any loose soil was removed. The cleaning effect of the plastic surface thus cleaned was determined using a Dr. B Lange "Microcolor" reflectance color measuring instrument. The measured quantity is the degree of whiteness. The clean white plastic surface served as the white standard. The degree of whiteness of the clean white plastic surface corresponds to 100% CP (cleaning power). Accordingly, the whiteness of a soiled and subsequently cleaned plastic surface corresponds to a value of 0% to 100% CP. The % CP values all represent average values of three determinations.

The measured values obtained were then related to the cleaning result obtained with a high-performance multipurpose cleaner used as standard.

$$\frac{\text{Measured values of the sample} \cdot 100}{\text{Measured value of the standard}} = \%\ CP\ \text{relative}$$

The high-performance formulation used as standard had the following composition:

| | |
|---|---|
| 8% | alkyl benzene sulfonate Na salt |
| 2% | adduct of $C_{12-14}$ alkyl epoxide + ethylene glycol + 10 moles of ethylene oxide |
| 2% | Na gluconate |
| 0.1% | polyethylene glycol, molecular weight approx. 600,000 (POLYOX ™ WSR 205, a product of UCC) |

Foaming behavior:

The foaming behavior of the multipurpose cleaners according to the invention was tested as follows. The product to be tested was placed in a wide-necked glass beaker. The quantity of tap water which, with the quantity of product introduced, produces an in-use concentration of the product of 10 g/l was then allowed to flow in freely from a height of 30 cm. The foam height in the glass beaker was read off immediately after the water had been added.

The following compositions were prepared by mixing the components together and then establishing the required pH value. All percentages are based on the % by weight of active substance.

Compositions 1 to 9 are set out in Table 1. Composition 1(C) does not correspond to the invention and is intended for comparison.

The fatty acid alkyl ester alkoxylates appear in the following notation in Table 1:

Example: $C_{12}FSEO_{15}Me$ stands for $C_{11}H_{23}CO_2(CH_2CH_2O)_{15}CH_3$, methyl ester of $C_{12}$ fatty acid ethoxylated with 15 ethylene oxide units.

EO stands for ethylene oxide and PO for propylene oxide. The degrees of alkoxylation represent mean values.

TABLE 1

| Figures in % by weight | 1(C) | 2 | 3 | 4 | 5 | 6 | 7 | 8 | 9 |
|---|---|---|---|---|---|---|---|---|---|
| Octanol · 4 EO (DEHYDOL ® 04 DEO, Henkel) | 2 | — | — | — | — | — | — | — | — |
| $C_{12}FSEO_{15}Me$ | — | 2 | — | — | — | — | — | — | — |
| $C_{6-10}FSEO_{10.6}Me$ | — | — | 2 | — | — | — | — | — | — |
| $C_{12}FSEO_{12}Me$ | — | — | — | 2 | — | — | 2 | 2 | 2 |
| $C_{6-10}FSEO_6Me$ | — | — | — | — | 2 | — | — | — | — |
| $C_{12}FSEO_6Me$ | — | — | — | — | — | 2 | — | — | — |
| APG 225 ($C_{8-10}$ alkyl polyglucoside, Henkel; DP = 1.6) | 3.5 | 3.5 | 3.5 | 3.5 | 3.5 | 3.5 | — | — | — |
| $C_8$ Alkyl polyglucoside (DP = 1.6) | — | — | — | — | — | — | 3.5 | — | — |
| $C_8$ Alkyl polyxyloside (DP = 1.4) | — | — | — | — | — | — | — | 3.5 | — |
| $C_{10}$ Alkyl polyxyloside (DP = 1.4) | — | — | — | — | — | — | — | — | 3.5 |
| $C_{12-18}$ Fatty acid (EDENOR ® K12/18, Henkel) | 0.6 | 0.6 | 0.6 | 0.6 | 0.6 | 0.6 | 0.6 | 0.6 | 0.6 |
| Succinic, glutaric, adipic acid (SOKALAN ™ DCS, BASF) | 2 | 2 | 2 | 2 | 2 | 2 | 2 | 2 | 2 |
| NaOH | 1.2 | 1.2 | 1.2 | 1.2 | 1.2 | 1.2 | 1.2 | 1.2 | 1.2 |
| pH | 7.0–7.5 | 7.0–7.5 | 7.0–7.5 | 7.0–7.5 | 7.0–7.5 | 7.0–7.5 | 7.0–7.5 | 7.0–7.5 | 7.0–7.5 |
| Cleaning power (%) | 61 | 74 | 66 | 74 | 68 | 64 | 66 | 69 | 67 |
| Foam height (cm) immediately after introduction of water: | 2 | 1.3 | 2 | 1.2 | 1 | 2.3 | 2.1 | 1.8 | 1.7 |
| Break-up of the foam covering (in mins) | 2.5 | 0.5 | 1 | 0.5 | 0.5 | 1 | 1 | 0.5 | 0.5 |

It can be seen that compositions 2 to 9 according to the invention are clearly superior to comparison composition 1(C) in regard to cleaning power and foam collapse.

The following Examples show other preferred formulations and potential applications for the claimed multipurpose cleaners.

EXAMPLE 10

| | |
|---|---|
| 45.0% | by weight $C_{8-10}$ alkyl polyglucoside, DP = 1.6 |
| 20.0% | by weight $C_2$ fatty acid methyl ester · 13 EO |
| 5.0% | by weight palm kernel oil fatty acid |
| 1.0% | by weight citric acid |
| 10.0% | by weight cumene sulfonate |
| | potassium hydroxide to adjust the end product to pH 8 |
| | dyes and fragrances |
| ad 100.0% | by weight water |

Example 10 represents a highly concentrated multipurpose cleaner which is used in the form of a 0.1% solution.

EXAMPLE 11

| | |
|---|---|
| 3.0% | by weight $C_{8-10}$ alkyl polyglucoside, DP = 1.6 |
| 1% | by weight butyl polyglucoside |
| 1% | by weight $C_{12}$ fatty acid methyl ester · 12 EO |
| 0.5% | by weight palm kernel oil fatty acid |
| 2.0% | by weight methacrylic acid (stearyl alcohol 20 EO ester)ester/acrylic acid copolymer (ACRYSOL ™ ICS-1, Rohm & Haas) |
| 0.05% | by weight polyethylene oxide, MW 600,000 |
| 2.0% | by weight butyl glycol |
| | sodium hydroxide for adjustment to pH 8 |
| | dyes and fragrances, preservative |
| ad 100.0% | by weight water |

EXAMPLE 12

| | |
|---|---|
| 0.2% | by weight $C_{10}$ alkyl polyglucoside, DP = 1.6 |
| 0.05% | by weight $C_{10-12}$ fatty acid methyl ester · 17 EO |
| 7.0% | by weight ethanol |
| | ammonium for adjustment to pH 8.3 |
| ad 100.0% | by weight water |

Example 12 represents a multipurpose spray cleaner which is applied in undiluted form using a hand spray pump. The foam collapse rate of this formulation is determined by visual observation of the spraying process: the sprayed surface to be cleaned did not show any foam bubbles immediately after application of the spray cleaner.

EXAMPLE 13

| | |
|---|---|
| 5% | by weight $C_{10}$ alkyl polyglucoside, DP = 1.6 |
| 4% | by weight $C_{12}$ fatty acid methyl ester · 6 EO |
| 2% | by weight octyl sulfate |
| 5% | by weight ethanol |
| 3% | by weight trisodium citrate |
| | citric acid for adjustuent to pH 5.5 |
| ad 100.0% | by weight water |

EXAMPLE 14

| | |
|---|---|
| 12% | by weight $C_{10}$ alkyl polyxyloside, DP = 1.4 |
| 8% | by weight $C_{12}$ fatty acid methyl ester · 11 EO |
| 2% | by weight $C_{12}$ fatty alcohol sulfate |
| 5% | by weight ethanol |
| | potassium hydroxide for adjustment to pH 7–7.5 |
| ad 100.0% | by weight water |

EXAMPLE 15

| | |
|---|---|
| 6% | by weight $C_{10}$ alkyl polyxyloside, DP = 1.4 |
| 8% | by weight $C_{12}$ fatty acid methyl ester · 11 EO |
| 6% | by weight $C_{12-14}$ fatty alcohol ether (2 EO) sulfate |
| 5% | by weight ethanol |
| | NaOH for adjustment to pH 7–7.5 |
| ad 100.0% | by weight water |

EXAMPLE 16

| | |
|---|---|
| 10% | by weight $C_8$ alkyl polyxyloside, DP = 1.4 |
| 8% | by weight $C_{12}$ fatty acid methyl ester · 11 EO |
| 2% | by weight decanol · 3 EO |
| 1.5% | by weight coconut oil fatty acid |
| 5% | by weight ethanol |
| | NaOH for adjustment to pH 7–7.5 |
| ad 100.0% | by weight water |

EXAMPLE 17

| | |
|---|---|
| 10% | by weight $C_{8-10}$ alkyl polyglucoside, DP = 1.6 |
| 8% | by weight $C_{8-16}$ fatty acid methyl ester · 18 PO |
| 2% | by weight $C_{13-18}$ sec.alkane sulfonate, Na salt |

-continued

| | |
|---|---|
| | (HOSTAPUR ™ SAS 60, Hoechst AG) |
| 3% | by weight cumene sulfonate |
| 1.5% | by weight coconut oil fatty acid |
| 5% | by weight ethanol |
| | NaOH for adjustment to pH 7–7.5 |
| ad 100.0% | by weight water |

EXAMPLE 18

| | |
|---|---|
| 1.5% | by weight APG 600 ($C_{12-14}$ alkyl polyglucoside, Henkel; DP = 1.4) |
| 1.5% | by weight $C_{12}$ fatty acid methyl ester · 15 EO |
| 1% | by weight methacrylic acid (stearyl alcohol 20 EO ester)ester/acrylic acid copolymer (ACRYSOL ™ ICS-1, Rohm & Haas) |
| 50% | by weight silica flour |
| | triethanolamine for adjustment to pH 8 |
| ad 100.0% | by weight water |

EXAMPLE 19

| | |
|---|---|
| 4.0% | by weight $C_{10}$ alkyl polyglucoside, DP = 1.6 |
| 5.0% | by weight $C_{12}$ fatty acid methyl ester · 17 EO |
| 1.0% | by weight octyl sulfate |
| 4.0% | by weight ethanol |
| 2.0% | by weight trisodium citrate |
| | citric acid for adjustment to pH 4.8 |
| ad 100.0% | by weight water |

EXAMPLE 20

| | |
|---|---|
| 8.0% | by weight $C_{12-14}$ alkyl polyglucoside, DP = 1.4 |
| 10.0% | by weight $C_{12-18}$ fatty acid methyl ester · 3 EO |
| 5.0% | by weight $C_{12}$ alkyl benzene sulfonate |
| 5.0% | by weight ethanol |
| 8.0% | by weight glycerol |
| 0.5% | by weight protease |
| 5.0% | by weight trisodium citrate |
| 0.1% | by weight dyes and fragrances |
| ad 100.0% | by weight water |

The detergent had excellent foaming properties (low foaming values)

EXAMPLE 21

Low-foaming water-containing liquid detergent D2:

| | |
|---|---|
| 9.0% | by weight $C_{12-14}$ alkyl polyglucoside, DP = 1.4 |
| 9.0% | by weight $C_{12-18}$ fatty acid methyl ester · 5 EO |
| 6.0% | by weight ethanol |
| 5.0% | by weight glycerol |
| 0.5% | by weight trisodium citrate |
| ad 100.0% | by weight water |

Determination of foaming in drum washing machines:

Water hardness : 16° d

Dosage : 0.8 g/l

Temperature : 60° C.

Foam scores : 0 means that no foam is visible at the bottom edge of the bull's eye of the washing machine 3 means that the height of the foam has reached half the bull's eye 5 means that the bull's eye is completely covered with foam A detergent C containing a $C_{13-15}$ alcohol·5 EO instead of the fatty acid methyl ester was tested for comparison.

| | Foam scores after minutes | | | |
|---|---|---|---|---|
| Detergent | 2 | 5 | 7 | 10 |
| D2 | 1 | 1 | 1 | 1 |
| C | 2.3 | 4 | 5 | 5.5 |

We claim:

1. A water-containing detergent composition or cleaning composition comprising

A) from about 0.1 to about 50% by weight of at least one alkyl polyglycoside corresponding to the formula $R^1$—O—$(Z)_x$(I), where $R^1$ is a linear or branched, saturated or unsaturated alkyl group containing 8 to 18 carbon atoms, Z is a sugar unit, and x is an integer of 1 to 10; and B) from about 0.05 to about 50% by weight of at least one fatty acid alkyl ester alkoxylate of the formula $R^2CO_2$—$(AO)_y$—$R^3$ (II), where $R^2$ is a branched or linear, saturated or unsaturated alkyl group containing 5 to 21 carbon atoms, AO is a $C_{2-4}$ alkylene oxide unit, y is a number of 1 to 30 and $R^3$ is a linear or branched alkyl group containing 1 to 6 carbon atoms.

2. The composition of claim 1 wherein components A) and B) are each present in from about 1 to about 20% by weight.

3. The composition of claim 1 wherein in formula I, Z is a glucose or xylose unit.

4. The composition of claim 1 wherein in formula I, x is an integer of from 1–6.

5. The composition of claim 1 wherein component A) is a mixture of compounds of formula I in which x has an average value in the range of from 1.1 to 3.0.

6. The composition of claim 5 wherein said average value for x is from 1.1 to 1.7.

7. The composition of claim 1 wherein $R^1$ in formula I contains from 8 to 12 carbon atoms.

8. The composition of claim 1 wherein in formula I, Z is a glucoside or xyloside unit, X is an integer of from 1 to 6, and $R^1$ contains from 8 to 12 carbon atoms.

9. The composition of claim 1 wherein in formula II AO is an ethylene oxide unit and $R^3$ is a methyl group.

10. The composition of claim 9 wherein in formula II, y is a number of from 5 to 25.

11. The composition of claim 10 wherein in formula II, y is a number of from 9 to 18.

12. The composition of claim 9 wherein in formula II, $R^2$ is a linear or branched, saturated alkyl group containing from 12 to 18 carbon atoms and y is a number of from 3 to 15.

13. The composition of claim 8 wherein in formula II AO is an ethylene oxide unit and $R^3$ is a methyl group.

14. The composition of claim 1 wherein the composition also contains an anionic surfactant selected from the group consisting of $C_{6-18}$ alkyl benzene sulfonates, $C_{6-18}$ alkane sulfonates, $C_{6-18}$ alkyl sulfates, $C_{6-18}$ alkyl polyglycol ether sulfates, α-olefin sulfonates, $C_{6-18}$ alkyl polyglycol ether sulfonates, glycerol ether sulfonates, glycerol ether sulfates, hydroxy mixed ether sulfates, monoglyceride sulfates, sulfosuccinates, sulfotriglycerides, soaps, amide soaps, $C_{6-18}$ fatty acid amide ether sulfates, $C_{6-18}$ alkyl carboxylates, fatty acid isethionates, N-$C_{6-18}$-acyl sarcosinates, N-$C_{6-18}$-acyl taurides, $C_{6-18}$ alkyl oligoglucoside sulfates, $C_{6-18}$ alkyl phosphates, and mixtures thereof, in a quantity of up to about 40% by weight, based on the total weight of the composition.

15. The composition of claim 1 wherein the composition also contains another nonionic surfactant selected from the group consisting of $C_{6-18}$ alkyl polyglycol ethers, sugar esters, $C_{6-18}$ fatty acid polyglycol ethers, sorbitan fatty acid esters, $C_{6-18}$ fatty acid partial glycerides, and mixtures thereof, in a total quantity of up to about 30% by weight, based on the total weight of the composition.

16. The composition of claim 15 wherein the another nonionic surfactant is selected from the group consisting of $C_{6-18}$ alkyl sulfates, $C_{6-18}$ alkyl polyglycol ether sulfates, soaps, $C_{6-18}$ alkane sulfonates, and mixtures thereof.

17. The composition of claim 15 wherein the another nonionic surfactant is a $C_{6-18}$ alkyl polyglycol ether.

18. A method for cleaning a hard surface comprising contacting the hard surface with the composition of claim 1.

19. A method for cleaning a hard surface comprising contacting the hard surface with the composition of claim 2.

20. A method for cleaning textiles comprising contacting the textiles to be cleaned with the composition of claim 1.

* * * * *